US010365040B2

(12) United States Patent
Zhao et al.

(10) Patent No.: US 10,365,040 B2
(45) Date of Patent: Jul. 30, 2019

(54) METHOD FOR DRYING HIGH MOISTURE, LOW CALORIFIC VALUE LIGNITE FOR A GENERATING SET AND RECOVERING WATER CONTAINED THEREIN AND APPARATUS THEREOF

(71) Applicant: TIANHUA INSTITUTE OF CHEMICAL MACHINERY AND AUTOMATION CO., LTD, Gansu (CN)

(72) Inventors: Xu Zhao, Gansu (CN); Yan Dou, Gansu (CN); Zhongfu Zhan, Gansu (CN); Yongpeng Tan, Gansu (CN); Jinwen Shi, Gansu (CN); Tao Shen, Gansu (CN); Yonggong Ling, Gansu (CN); Wei Yang, Gansu (CN); Yan Zhang, Gansu (CN)

(73) Assignee: TIANHUA INSTITUTE OF CHEMICAL MACHINERY AND AUTOMATION CO., LTD, Gansu (CN)

( * ) Notice: Subject to any disclaimer, the term of this patent is extended or adjusted under 35 U.S.C. 154(b) by 359 days.

(21) Appl. No.: 15/312,908

(22) PCT Filed: Mar. 2, 2015

(86) PCT No.: PCT/CN2015/073512
§ 371 (c)(1),
(2) Date: Nov. 21, 2016

(87) PCT Pub. No.: WO2015/176570
PCT Pub. Date: Nov. 26, 2015

(65) Prior Publication Data

US 2017/0153025 A1 Jun. 1, 2017

(30) Foreign Application Priority Data

May 20, 2014 (CN) ..... 2014 1 0212768

(51) Int. Cl.
*F26B 21/00* (2006.01)
*B02C 21/00* (2006.01)
(Continued)

(52) U.S. Cl.
CPC ..... *F26B 21/005* (2013.01); *B02C 21/00* (2013.01); *C10L 5/04* (2013.01); *C10L 5/366* (2013.01);
(Continued)

(58) Field of Classification Search
CPC ..... F26B 21/005; F26B 3/04; F26B 17/00; F26B 3/00; F26B 20/00; F26B 21/00;
(Continued)

(56) References Cited

U.S. PATENT DOCUMENTS 4,601,115 A * 7/1986 Draper ..... C10F 5/00 34/131
9,944,874 B2 * 4/2018 Edel ..... C10L 5/04
(Continued)

FOREIGN PATENT DOCUMENTS

CN 101881191 A 11/2010
CN 102840593 A 12/2012
(Continued)

*Primary Examiner* — David J Laux
(74) *Attorney, Agent, or Firm* — Muncy, Geissler, Olds & Lowe, P.C.

(57) ABSTRACT

A method for drying high moisture, low calorific value lignite for a generating set and recovering water contained therein and an apparatus thereof mainly consist of a rotary steam tube dryer, a washing cooling tower, a coal mill, a first bag filter, a condenser, a weighing surge bunker, a water ring vacuum pump and so on. A drying system is integrated with a milling system, every dryer and the corresponding coal mill are disposed and are directly connected via a surge bunker, thereby not only saving the heat lost during the transportation of pulverized coal, but also omitting a long-
(Continued)

distance transportation from a conventional drying system to a conventional milling system, effectively avoiding such phenomena as dust pollution, waste and spontaneous combustion during transportation and transshipment, simplifying the coal preparation system employed in the front-end process of drying.

20 Claims, 1 Drawing Sheet

(51) Int. Cl.

| | |
|---|---|
| ***F26B 3/00*** | (2006.01) |
| ***F26B 20/00*** | (2006.01) |
| ***F23K 3/02*** | (2006.01) |
| ***F26B 3/04*** | (2006.01) |
| ***F26B 17/00*** | (2006.01) |
| ***F26B 25/22*** | (2006.01) |
| ***C10L 5/04*** | (2006.01) |
| ***C10L 5/36*** | (2006.01) |
| ***C10L 9/00*** | (2006.01) |

(52) U.S. Cl.
CPC *C10L 9/00* (2013.01); *F23K 3/02* (2013.01); *F26B 3/00* (2013.01); *F26B 3/04* (2013.01); *F26B 17/00* (2013.01); *F26B 20/00* (2013.01); *F26B 21/00* (2013.01); *F26B 25/22* (2013.01); *C10L 2270/04* (2013.01); *C10L 2290/02* (2013.01); *C10L 2290/06* (2013.01); *C10L 2290/08* (2013.01); *C10L 2290/10* (2013.01); *C10L 2290/143* (2013.01); *C10L 2290/145* (2013.01); *C10L 2290/146* (2013.01); *C10L 2290/28* (2013.01); *C10L 2290/46* (2013.01); *C10L 2290/52* (2013.01); *C10L 2290/545* (2013.01); *C10L 2290/547* (2013.01); *C10L 2290/58* (2013.01); *C10L 2290/60* (2013.01); *F23K 2201/10* (2013.01); *F23K 2201/20* (2013.01); *F23K 2203/006* (2013.01)

(58) Field of Classification Search
CPC ..... F23K 3/02; F23K 2201/20; C10L 9/00; C10L 2290/08; C10L 2290/547; C10L 2290/545; C10L 2290/06; C10L 2290/10; C10L 2290/146
See application file for complete search history.

(56) References Cited

U.S. PATENT DOCUMENTS

| | | | | |
|---|---|---|---|---|
| 9,944,875 | B2 * | 4/2018 | Edel | C10L 5/04 |
| 2011/0214427 | A1 * | 9/2011 | Zhao | F01K 17/06 60/653 |
| 2012/0006025 | A1 * | 1/2012 | Koyama | F01K 9/003 60/670 |

FOREIGN PATENT DOCUMENTS

| | | | |
|---|---|---|---|
| CN | 103673534 | A | 3/2014 |
| JP | 2007039613 | A | 2/2007 |

* cited by examiner

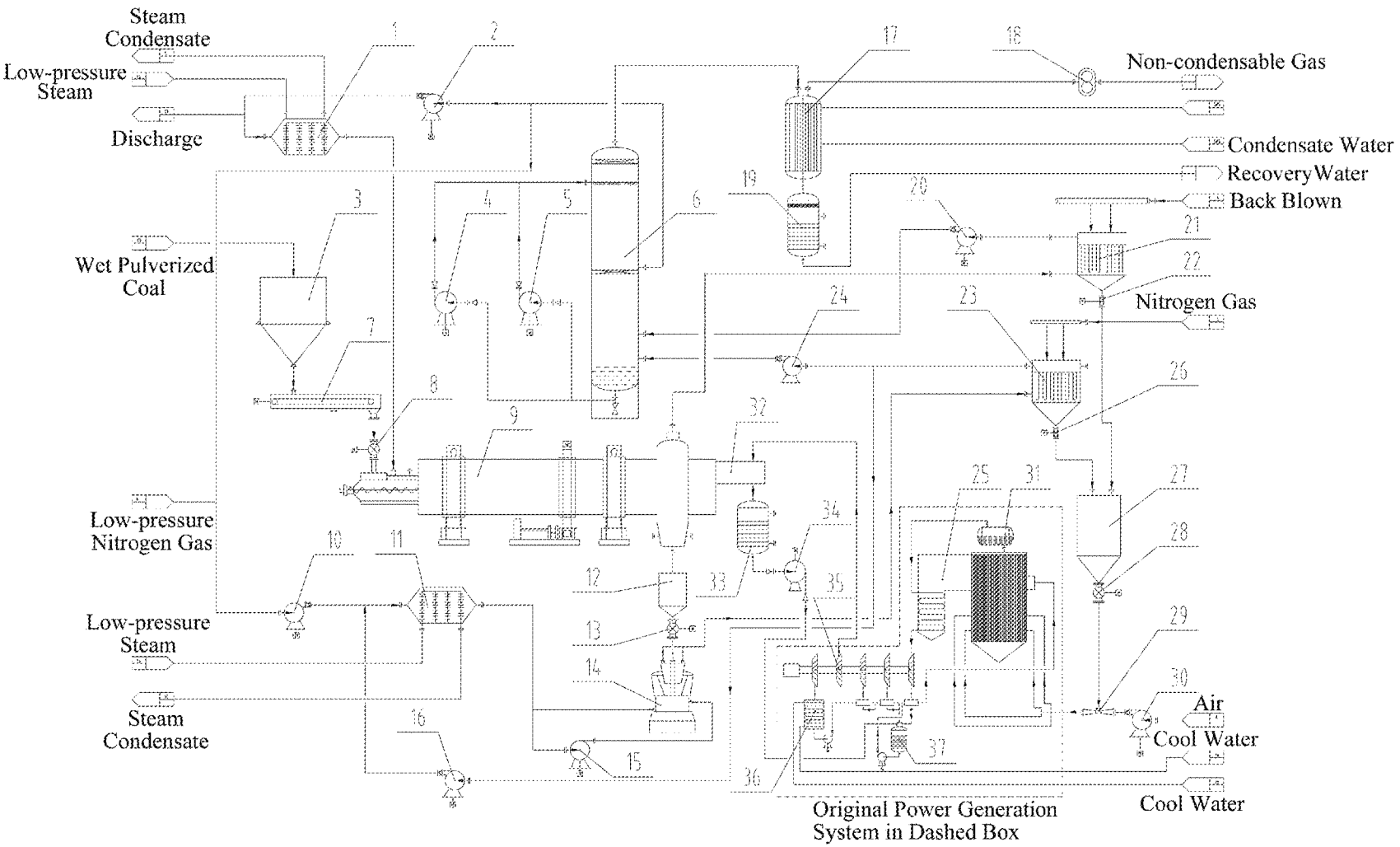
Non-condensable Gas
Condensate Water
Recovery Water
Back Blown
Nitrogen Gas
Air
Cool Water
Cool Water
Original Power Generation System in Dashed Box
Steam Condensate
Low-pressure Steam
Discharge
Wet Pulverized Coal
Low-pressure Nitrogen Gas
Low-pressure Steam
Steam Condensate

METHOD FOR DRYING HIGH MOISTURE, LOW CALORIFIC VALUE LIGNITE FOR A GENERATING SET AND RECOVERING WATER CONTAINED THEREIN AND APPARATUS THEREOF

FIELD OF THE INVENTION

The present invention relates to a method for drying high moisture, low calorific value lignite for a generating set and recovering water contained therein and an apparatus thereof. The apparatus is additionally provided with a system for drying lignite and recovering water, so that high moisture lignite has an increased calorific value to meet electricity generation requirements, and water in the lignite can be recovered and used as a supplementary source of water, thereby reducing water consumption and saving energy.

BACKGROUND

For the milling system employed in a conventional coal-fired power plant, a coal mill (routinely there are two types of coal mills: medium speed coal mills and fan-type coal mills) is used for milling and drying coal, into which is introduced hot flue gas at 150 to 300° C. from a coal-fired boiler economizer, and then blowing the resulting powder into a boiler and burning it. However, this method has such shortcoming that the degree of drying is so low that it is impossible to directly make high moisture lignite meet electricity generation requirements and moisture in the lignite cannot be recovered.

The drying system and the milling system employed in the above-mentioned conventional coal-fired power plant are two independent units, so the dried coal is transported to a coal bunker of the milling system via transportation equipment such as a scraper, a belt conveyor and a bucket elevator, etc. But there are problems as follows:

(1) The temperature of the dried pulverized coal ranges from 60 to 80° C., thus a large amount of dust and steam are produced during transport. Due to the major amount of fine powder and lower moisture content, a large amount of dust is easy to produce when a belt conveyor, a scraper or the like is used for transport. As a consequence, the environment is contaminated and the operating environment is relatively bad; besides, fine pulverized coal would spontaneously ignite very easily, and even a serious accident like flash explosion would occur, thereby affecting the stability of transportation equipment.

(2) The temperature of the hot coal, which has a temperature ranging from 60 to 80° C. after drying, is reduced to 30 to 60° C. through the step of transportation, and then the coal is fed into a coal mill and accordingly milled. The heat energy carried by the dried hot coal is wasted. According to calculation, the heat energy thus wasted accounts for 5 to 20% of the energy required by the milling system.

(3) The dry exhaust produced by coal drying is dedusted and then directly discharged into atmosphere. The heat and water vapor contained in the exhaust are not recycled.

SUMMARY OF THE INVENTION

To overcome the problems existing in the drying and milling of lignite in conventional coal-fired power plants, the present invention provides an apparatus for drying high moisture, low calorific value lignite for a generating set and recovering water contained therein, comprising a rotary steam tube dryer, a washing cooling tower, a coal mill, a first bag filter, a second bag filter, a steam condenser, a weighing surge bunker, a water ring vacuum pump, a Venturi jet pump, a wet coal bunker, a nitrogen gas heater and a pulverized coal collecting tank;

wherein the input end of the rotary steam tube dryer is connected with the wet coal bunker, the upper portion of the other end thereof is connected with the first bag filter and the lower portion is connected with the weighing surge bunker, the upper portion of the first bag filter is connected to the washing cooling tower, the weighing surge bunker is connected to the coal mill, one side of the coal mill is connected to the nitrogen gas heater, the top of the coal mill is connected to the second bag filter, the upper portion of the second bag filter is connected to the washing cooling tower and the other side thereof is connected to the inlet of the nitrogen gas heater, and the lower portion of the second bag filter is connected to the pulverized coal collecting tank; the upper portion of the first bag filter is connected to the washing cooling tower, and the lower portion thereof is connected to the pulverized coal collecting tank; one side of the washing cooling tower is connected to the nitrogen gas heater.

To solve the above problems, the present invention further provides a method for drying high moisture, low calorific value lignite for a generating set and recovering water contained therein, comprising the following steps:

step 1: by means of Level 1 drying, wet coal is crushed, passed through a wet coal bunker, fed into a rotary steam tube dryer in sequence, and then heated and dried in heating steam and a dry carrier gas for a certain time to obtain coal particles B with a certain proportion of water and dry gas F at a certain temperature; the dry exhaust is fed into a first bag filter and dedusted therein to obtain exhaust D containing water vapor and pulverized coal T, the pulverized coal T is directly fed into a collecting tank, and at the same time the exhaust D is fed into a washing cooling tower;

step 2: by means of Level 2 drying and milling, the coal particles B are fed into a surge bunker and then into a coal mill, and milled under preset conditions for a preset time to obtain the dried, pulverized coal C; after nitrogen gas P is heated by a nitrogen gas heater to a preset temperature, a portion of the nitrogen gas P is introduced into the coal mill to dry and mill the coal particles B so as to obtain pulverized coal C; the other portion of the nitrogen gas P is introduced into the coal mill through a sealing fan and sealed for later use; exhaust G discharged from the top of the coal mill is introduced into a second bag filter and collected therein to obtain pulverized coal C and the dedusted exhaust H, wherein the pulverized coal C is directly fed into a pulverized coal collecting tank and collected therein, a portion of the exhaust H is sent back to the nitrogen gas heater and heated therein to a preset temperature, and then introduced into the coal mill, while the other portion of the exhaust H is fed into the washing cooling tower and treated therein;

step 3: the exhaust D and the exhaust H are cooled and dehumidified in the washing cooling tower to form bottom liquid J in the bottom of the washing cooling tower, water vapour obtained by vacuum flash cooling of the bottom liquid J is dehumidified and then introduced into a steam condenser to be condensed, so as to form clean water M which is transported to a condensate water recovery tank and stored therein, and at the same time non-condensable gas that cannot be condensed is discharged into the air;

step 4: a portion of nitrogen gas E discharged from the side of the washing cooling tower is introduced into a carrier gas heater and heated therein, and then introduced into the input end of a rotary steam tube dryer for use as a dry carrier gas; the other portion of the nitrogen gas E is introduced into the nitrogen gas heater and heated therein, and then introduced into the coal mill for use as a medium for drying and milling, so as to form a nitrogen gas closed loop system;

step 5: the pulverized coal T and the pulverized coal C are mixed together in the pulverized coal collecting tank, then fed into the Venturi jet pump, mixed with air and burned in a boiler 25° C.

The present invention has the following advantages over the prior art:

1. The present invention makes it possible that after high moisture lignite is dried by a rotary steam tube dryer, the lignite with a moisture content as high as 61.3% generates electricity at full load, thereby meeting the operating requirements of coal-fired power plants and transforming low-quality coal which cannot be applied into steam coal which can generate electricity, so that the low-quality coal can be utilized effectively and the range of resource utilization is broadened.

2. The present invention makes it possible that 95% of moisture in high moisture lignite is recovered and changed into clean water after washing, flashing, dehumidification and condensation, for use as make-up water recycling in power plants, thereby saving valuable water resources.

3. All of the heat sources employed in the present invention come from steam extracted by a steam turbine. Utilization of the loss of cold sources in the system (i.e., utilization of latent heat of condensation after the work of high-pressure high-temperature steam) not only greatly reduces the energy consumption of a drying system but also can significantly reduce the power supply coal consumption of a generating set.

4. In the present invention, a drying system is integrated with a milling system, every rotary steam tube dryer and the corresponding coal mill are disposed, i.e., the outlet of a rotary steam tube dryer is directly connected to a coal mill via a surge bunker, and the dried pulverized coal is milled in the coal mill after a buffer, thereby not only saving the heat lost during the transportation of pulverized coal, but also omitting a long-distance transportation from a conventional drying system to a conventional milling system, and shortening the process flow so as to effectively avoid such phenomena as dust pollution, waste and spontaneous combustion during transportation and transshipment.

5. The present invention leaves out the intermediate, complex step of transportation, but only uses a surge bunker and a measuring rotary valve instead; meanwhile, the coal preparation system employed in the front-end process of drying is simplified, thereby saving the construction investment in coal bunkers of the original milling system and significantly reducing production costs.

6. In the present invention, by virtue of the drying function of a conventional milling system, the drying system is divided into two levels: Level 1 drying using a steam rotary dryer and Level 2 drying using a milling system. Thus, the moisture content of high moisture lignite can be reduced to from 2 to 5%, thereby greatly increasing the calorific value of lignite.

7. The coal drying system according to the present invention allows inert gases to be circulated and dried. A washing cooling tower recovers the water vapor contained in dry exhaust as clean water. After heating of the nitrogen gas discharged, it is returned to the Level 1 drying system, the Level 2 drying system and the milling system, and becomes a dry carrier gas and a heat source for Level 2 drying and milling, thereby achieving the closed circulation of the drying system and reducing energy consumption. Meanwhile, the oxygen content of the drying system is absolutely controllable; the dried exhaust (containing a large amount of water vapor) after dust collection is directly discharged into atmosphere, and the heat and water vapor contained in the exhaust are recycled. Dried exhaust will not be discharged into atmosphere any longer, thus coal drying systems in power plants will be safer and more environmentally friendly.

8. The present invention requires low investment, causes low energy consumption, has a high economic value, and is easy to carry out.

BRIEF DESCRIPTION OF THE DRAWINGS

The sole FIGURE is a process flow chart of the present invention, wherein within the dotted box is a conventional generating set.

The following is a description of the drawing:

| | |
|---|---|
| 1-Carrier gas heater | 2-third circulating fan III |
| 3-Wet coal bunker | 4-first cleaning circulation pump |
| 5-2nd cleaning circulation pump | 6-Washing cooling tower |
| 7-Measuring belt scale | 8-Rotary seal valve |
| 9-Rotary steam tube dryer | 10-fourth circulating fan IV |
| 11-Nitrogen gas heater | 12-Surge bunker |
| 13-first measuring rotary valve I | 14-Coal mill |
| 15-Sealing fan | 16-fifth circulating fan V |
| 17-Steam condenser | 18-Water ring vacuum pump |
| 19-Condensate water recovery tank | 20-first circulating fan I |
| 21-first bag filter I | 22-first double-layer electric flap valve I |
| 23-second bag filter II | 24-second circulating fan II |
| 25-Coal-fired boiler | 26-second double-layer electric flap valve II |
| 27-Pulverized coal collecting tank | 28-second measuring rotary valve II |
| 29-Venturi jet pump | 30-Conveying fan |
| 31-Boiler drum | 32-Rotary joint |
| 33-Condensate storage tank | 34-Condensate pump |
| 35-Steam turbine | 36-Condenser |
| 37-Deaerator | |

DESCRIPTION OF THE PREFERRED EMBODIMENTS

Hereinafter, the technical solution of the present invention is further described in detail with reference to the accompanying drawing.

As shown in the sole FIGURE, an apparatus for drying high moisture, low calorific value lignite for a generating set and recovering water contained therein mainly comprises a rotary steam tube dryer 9, a washing cooling tower 6, a coal mill 14, a first bag filter 21, a second bag filter 23, a condenser 19, a weighing surge bunker 12, a water ring vacuum pump 18, a Venturi jet pump 29, a wet coal bunker 3, a nitrogen gas heater 11, circulating fans and a pulverized coal collecting tank 27. The input end of the rotary steam tube dryer 9 is connected with the wet coal bunker 3 through a measuring belt scale 7 and a rotary seal valve 8, the upper portion of the other end thereof is connected with the first bag filter 21 and the lower portion of the other end thereof is provided with the weighing surge bunker 12, and the upper portion of the first bag filter 21 is connected to the washing cooling tower 6 via a second circulating fan 20; the weighing surge bunker 12 is connected to the coal mill 14 via a first measuring rotary valve 13; one side of the coal mill 14 is connected to a 4th circulating fan 10 via the nitrogen gas heater 11 and the other side thereof is connected to a sealing fan 15, and the top of the coal mill 14 is provided with the second bag filter 23; one side of the upper portion of the second bag filter 23 is connected to the washing cooling tower 6 via a second circulating fan 24 and the other side is connected to the inlet of the nitrogen gas heater 11 via a 5th circulating fan 16, and the lower portion is connected to the pulverized coal collecting tank 27 via a second double-layer electric flap valve 26; the upper portion of the first bag filter 21 is connected to the washing cooling tower 6 via a first circulating fan 20, and the lower portion is connected to the pulverized coal collecting tank 27 via a first double-layer electric flap valve 22; one side of the washing cooling tower 6 is connected to a carrier gas heater 1 via a 3rd circulating fan 2 and the other side is connected to the nitrogen gas heater 11 via a 4th circulating fan 10, the bottom thereof is provided with a cleaning circulation pump 4 and a second cleaning circulation pump 5, and the top thereof is connected to the steam condenser 17; the top of the steam condenser 17 is connected to the water ring vacuum pump 18, the middle portion of the steam condenser 17 is provided with a cool water inlet, the upper portion and the bottom thereof are each provided with a cool water back-water inlet, and the bottom is connected to a condensate water recovery tank 19; the carrier gas heater 1 is connected to the input end of the rotary steam tube dryer 9; the pulverized coal collecting tank 27 is connected to the Venturi jet pump 29 via a second measuring rotary valve 28; one side of the Venturi jet pump 29 is connected to a conveying fan 30 which is connected to a coal-fired boiler 25, and the other side thereof is connected to atmosphere; the upper portion of a rotary joint 32 at the tail end of the rotary steam tube dryer 9 is connected to the pump cylinder of a steam turbine 35, and the lower portion thereof is connected to a condensate storage tank 33; the condensate storage tank 33 is connected to a condensate pump 34, the condensate pump 34 is connected to a condenser 36, the condenser 36 is connected to a deaerator 37, and the deaerator 37 is connected to a boiler drum 31.

The carrier gas heater 1 plays a part in steaming new liquid and heating low-pressure steam, and transporting the steam to the rotary steam tube dryer 9. Five circulating fans are used for compressing and transporting exhaust containing water vapor and nitrogen gas. The wet coal bunker 3 is provided with a hopper used for supplying the rotary steam tube dryer 9 with wet lignite. The two cleaning circulation pumps play a part in circulating the bottom liquid stored in the washing cooling tower 6 into a flash zone at the top of the washing cooling tower 6 for vacuum flashing under the action of the pumps; the washing cooling tower 6 plays a part in bringing the exhaust, which contains water vapor and nitrogen gas and which is introduced from the circulating fans, into vapor-liquid reverse contact with the overhead cool water cooled by vacuum flashing in the tower, for the purpose of cooling dehumidification. The measuring belt scale 7 plays a part in measuring wet coal in the wet coal bunker 3 and transporting the wet coal to the rotary steam tube dryer 9 via the rotary seal valve 8. The rotary seal valve 8 plays a part in transporting the wet coal measured by the measuring belt scale 7 to the rotary steam tube dryer 9 relatively airtightly. The rotary steam tube dryer 9 is an inclined rotary cylinder, within which a number of tube arrays are arranged, wherein 2 to 7 layers of tube arrays are concentrically arranged, steam passes through the tubes and coal is passed through outside of tubes, the input end of the dryer 9 is provided with a coal particle inlet and a carrier gas inlet, and the output end of the dryer 9 is provided with a coal particle outlet, an exhaust outlet, a steam inlet and a condensate outlet. The nitrogen gas heater 11 is a device for heating low-pressure nitrogen gas to be transported to the washing cooling tower 6. The surge bunker 12 plays a part in adjusting and balancing the coal particles dried by the rotary steam tube dryer 9, and feeding them into the coal mill 14 via the measuring rotary valves. The two measuring rotary valves play a part in measuring the coal weighed and dried by the surge bunker 12, and feeding them into the coal mill 14. The coal mill 14 mills the coal particles dried by the rotary steam tube dryer 9 into fine pulverized coal, and the sealing fan 15 plays a part in filtering nitrogen gas and introducing it into the coal mill 14 for later use. The two bag filters filter pulverized coal and the dry exhaust containing water vapor, the pulverized coal is fed into the collecting tank, and the dry exhaust containing nitrogen gas, water vapor and a small amount of air is introduced by the circulating fans into the washing cooling tower 6. The condenser 17 plays a part in performing vacuum flashing in the flash zone at the top of the washing cooling tower 6; water vapor K obtained by flash distillation is dehumidified and then fed into the condenser 17 by means of the pumping action of a water ring vacuum pump 18, the water vapor K is condensed in the condenser 17 and accordingly transformed into clean water M at a temperature below 40° C., and the clean water M is directly fed into a condensate water recovery tank 19 and stored therein. The water ring vacuum pump 18 is used for pumping the water vapor obtained by flash distillation at the top of the washing cooling tower into condenser 17 for condensation. The condensate water recovery tank 19 is used for storing the condensed water produced from the condenser 17. The two double-layer electric flap valves play a part in quickly discharging the pulverized coal filtered by the bag filters into a pulverized coal collecting tank 27 by electric control. The pulverized coal collecting tank 27 plays a part in collecting the water vapor, nitrogen gas and pulverized coal filtered by the second bag filter 23. The Venturi jet pump 29 plays a part in injecting a mixture of the pressurized air and the pulverized coal into a boiler via a nozzle for combustion. The conveying fan 30 plays a part in emitting the purified exhaust into the atmosphere.

In order to meet the requirements of coal-fired power plants for utilization of lignite, the present invention puts forward Level 2 drying of lignite. That is to say, the rotary steam tube dryer 9 is responsible for Level 1 drying, the coal mill 14 is responsible for Level 2 drying, the heat source for Level 1 drying is 0.3 to 2.0 MPa and has a temperature of 120 to 360° C., the heat source for Level 2 drying is hot nitrogen gas at 150 to 200° C., the heat source for Level 1 drying is steam extracted by the steam turbine 35, and after heat transfer, the steam is changed into a condensate which is then returned to the deaerator 37 to form a closed cycle of a heat source for drying; after drying, milling, dedusting, washing and other process steps, the heat source for Level 2 drying is returned to the nitrogen gas heater 11 via the 4th circulating fan 10 to form a closed cycle of a heat source for drying and milling.

In order to control the flow of lignite, each of the coal mill 14, the first circulating fan 20, the second circulating fan 24, the circulating fan III 2, the circulating fan IV 10, the circulating fan V 16, the sealing fan 15, the vacuum pump 18, the first cleaning circulation pump 4 and the second cleaning circulation pump 5 according to the present invention is provided with a flowmeter 5. In addition, all of the inlets of the rotary steam tube dryer 9, the coal mill 14 and the Venturi jet pump 29 are provided with measuring and weighing devices.

The carrier gas heater 1 and the nitrogen gas heater 11 are liquid-gas type finned tube heaters for heating using hot water or tubular heat exchangers.

The washing cooling tower 6 is any one of a packed tower, a plate tower or a spray tower.

The bag filter I 21 and the bag filter II 23 are efficient, offline nitrogen back blow filters.

Hereinafter the steps of the method adopted for the drying milling and water recovery devices of a power generation system using a pulverized coal furnace, in which high moisture, low calorific value lignite burns, are described as follows:

(1) After wet coal A with a moisture content of 25% to 62% is crushed such that it had a particle size ≤20 mm, it is fed into the wet coal bunker 3 and then into the rotary steam tube dryer 9 through the measuring belt scale 7 and the rotary seal valve 8, and coal particles B with a moisture content ≤15% after drying and dry exhaust F at a temperature of 90 to 110° C. are obtained after drying for 30 to 60 min on the condition that the heating steam had a steam pressure of 0.3 to 2.0 MPa and a temperature of 120 to 360° C. and the dry carrier gas had a temperature below 120° C. (carrier gas flow: 15000 to 35000 Nm3/h), i.e., under the conditions of nitrogen gas N; the coal particles B are fed into the surge bunker 12, and the dry exhaust F is fed into the first bag filter 21 and dedusted therein at a pressure of −200 to 500 Pa and a temperature of 90 to 110° C. to obtain exhaust D containing water vapor and pulverized coal T, the pulverized coal T is directly fed into the collecting tank 27, and the exhaust D containing nitrogen gas, water vapor and a small amount of air is introduced by the first circulating fan 20 into the washing cooling tower 6 to complete the process of Level 1 drying.

(2) After the coal particles B are fed into the surge bunker 12, they are measured through a weighing device disposed in the middle portion of the surge bunker 12 and a measuring rotary valve 13 disposed in the lower portion of the surge bunker 12, and then fed into the coal mill 14. After milling at a hot-air pressure of 2000 to 6000 Pa and a temperature of 180 to 200° C. for 6 to 25 S, pulverized coal C with a moisture content ≤2 to 5% after drying are obtained; nitrogen gas P is blown into the nitrogen gas heater 11 through the 4th circulating fan 10 and then is heated thereby to 180 to 200° C., wherein 90% of the hot nitrogen gas P is fed into the coal mill 14 to dry and mill the coal particles B to obtain pulverized coal C, and 10% of the hot nitrogen gas P is introduced into the coal mill 14 through the sealing fan 15 and sealed for later use; exhaust G cooled to 90 to 110° C. after drying and milling is discharged from the top of the coal mill 14, the exhaust G containing large amounts of pulverized coal C, water vapor and nitrogen gas is introduced into the second bag filter 23 via the second circulating fan 24 and collected in the second bag filter 23 to obtain pulverized coal C and the dedusted exhaust H containing water vapor and nitrogen gas; the pulverized coal C is directly fed into the pulverized coal collecting tank 27; 15% of the exhaust H is directly sent back to the inlet of the nitrogen gas heater 11 via the 5th circulating fan 16 and then mixed with the nitrogen gas E sent back by the 4th circulating fan 10, the resulting mixture is heated to 180 to 200° C. and then directly introduced into the coal mill 14 for later use, wherein after 85% of the exhaust H is fed into the washing cooling tower 6 via the second circulating fan 24 and treated in the washing cooling tower 6, the process of Level 2 drying and milling is completed.

(3) After the exhaust D containing nitrogen gas, water vapor and a small amount of air and the exhaust H containing water vapor and nitrogen gas are introduced into the washing cooling tower 6, they are brought into vapor-liquid reverse contact with the cool water cooled by flash distillation in the flash zone at the top of the washing cooling tower 6 to 40 to 60° C. in the washing cooling tower 6, so that they are cooled and dehumidified. The large amount of water vapor in the exhaust D and the exhaust H is condensed and accumulated in the bottom of the washing cooling tower 6 to form bottom liquid J at a temperature ranging from 80 to 90° C.; the bottom liquid J at 80 to 90° C. stored in the bottom of the washing cooling tower 6 is fed into the flash zone at the top of the washing cooling tower 6 for vacuum flashing under the action of the first cleaning circulation pump 4 and the second cleaning circulation pump 5, water vapor K at 40 to 70° C. flashed off is dehumidified and then fed into the condenser 17 by means of the pumping action of the water ring vacuum pump 18, the water vapor K is condensed in the condenser 17 and accordingly transformed into clean water M at a temperature below 40° C., the clean water M is directly fed into the condensate water recovery tank 19 and stored therein, and non-condensable gas that could not be condensed is evacuated from the water ring vacuum pump 18; the bottom liquid J at 40 to 60° C. obtained after flash cooling is fed into the distributor of the washing cooling tower 6 via a liquid level control system, and is brought into reverse contact with the exhaust G and the exhaust H again to be cooled and dehumidified so as to form a closed loop system; the cooling medium of the condenser 17 is circulating cool water; after the recovery of the water vapor in the exhaust G and the exhaust H, the remaining nitrogen gas E is recycled to Level 1 and Level 2 drying systems.

(4) The temperature of the nitrogen gas E discharged from the side of the washing cooling tower 6 after dehumidification and cooling ranged from 45 to 65° C., wherein 35% of the nitrogen gas E is pressurized by the 3rd circulating fan 2 to form nitrogen gas N, which is blown into the carrier gas heater 1 and heated therein to 120° C. or less, and then introduced into the input end of the rotary steam tube dryer 9 for use as a dry carrier gas, 65% of the nitrogen gas E is pressurized by the 4th circulating fan 10 to form nitrogen gas P, which is blown into the nitrogen gas heater 11 and heated therein to 180 to 200° C., and then introduced into the coal mill 14 for use as a medium for drying and milling, so as to form a nitrogen gas closed loop system, and a loss of nitrogen cycle of 5% or less is supplemented by an external system.

(5) After the pulverized coal T and the pulverized coal C discharged from the first bag filter 21 and the second bag filter 23 into the pulverized coal collecting tank 27 are mixed together, the resulting mixture is discharged from the measuring rotary valve 28 and fed into the Venturi jet pump 29. By virtue of the pressurization of the conveying fan 30, air is introduced into the Venturi jet pump 29 and mixed with the pulverized coal, and then the resulting mixture is blown into the boiler 25 for combustion.

(6) All of the heating media employed in the carrier gas preheater 1, the steam rotary dryer 9 and the nitrogen gas heater 11 came from steam extracted by the steam turbine 35, and they are pressurized by the condensate pump 34 and sent back to the deaerator 37 via the rotary joint 32 and the condensate storage tank 33.

What is claimed is:

1. An apparatus for drying high moisture, low calorific value lignite for a generating set and recovering water contained therein, comprising a rotary steam tube dryer, a washing cooling tower, a coal mill, a first bag filter, a second bag filter, a steam condenser, a weighing surge bunker, a water ring vacuum pump, a Venturi jet pump, a wet coal bunker, a nitrogen gas heater and a pulverized coal collecting tank;

wherein the input end of the rotary steam tube dryer is connected with the wet coal bunker, the upper portion of the other end of the rotary steam tube dryer is connected with the first bag filter and the lower portion of the other end of the rotary steam tube dryer is connected with the weighing surge bunker, the weighing surge bunker is connected to the coal mill, one side of the coal mill is connected to the nitrogen gas heater, the top of the coal mill is connected to the second bag filter, one side of the upper portion of the second bag filter is connected to the washing cooling tower and the other side of the upper portion of the second bag filter is connected to the inlet of the nitrogen gas heater, and the lower portion of the second bag filter is connected to the pulverized coal collecting tank; the upper portion of the first bag filter is connected to the washing cooling tower, and the lower portion of the first bag filter is connected to the pulverized coal collecting tank; one side of the washing cooling tower is connected to the nitrogen gas heater.

2. The apparatus according to claim 1, wherein the bottom of the washing cooling tower is connected to a first cleaning circulation pump and a second cleaning circulation pump, and the top of the washing cooling tower is connected to the steam condenser.

3. The apparatus according to claim 1, wherein the top of the steam condenser is connected to the water ring vacuum pump, the middle portion of the steam condenser is provided with a cool water inlet, the upper portion and the bottom of the steam condenser are each provided with a cool water backwater inlet, and the bottom is connected to a condensate water recovery tank.

4. The apparatus according to claim 1, wherein a carrier gas heater is connected to the other side of the washing cooling tower, and the carrier gas heater is also connected to the input end of the rotary steam tube dryer.

5. The apparatus according to claim 1, wherein the pulverized coal collecting tank is connected to the Venturi jet pump via a second measuring rotary valve, one side of the Venturi jet pump is connected to a conveying fan which is connected to a coal-fired boiler, and the other side of the Venturi jet pump communicates with atmosphere.

6. The apparatus according to claim 1, wherein the tail end of the rotary steam tube dryer is provided with a rotary joint, the upper portion of the rotary joint is connected to the pump cylinder of a steam turbine, and the lower portion of the rotary joint is connected to a condensate storage tank.

7. The apparatus according to claim 6, wherein the condensate storage tank is connected to a condensate pump, the condensate pump is connected to a condenser, the condenser is connected to a deaerator which is connected to a boiler drum.

8. A method for drying high moisture, low calorific value lignite for a generating set and recovering water contained therein, comprising the following steps:

step 1: by means of Level 1 drying, wet coal is crushed, passed through a wet coal bunker, fed into a rotary steam tube dryer in sequence, and then heated and dried in heating steam and a dry carrier gas for a certain time to obtain coal particles B with a certain proportion of water and dry gas F at a certain temperature; the dry exhaust is fed into a first bag filter and dedusted therein to obtain exhaust D containing water vapor and pulverized coal T, the pulverized coal T is directly fed into a collecting tank, and at the same time the exhaust D is fed into a washing cooling tower;

step 2: by means of Level 2 drying and milling, the coal particles B are fed into a surge bunker and then into a coal mill, and milled under preset conditions for a preset time to obtain the dried, pulverized coal C; after nitrogen gas P is heated by a nitrogen gas heater to a preset temperature, a portion of the nitrogen gas P is introduced into the coal mill to dry and mill the coal particles B so as to obtain pulverized coal C; the other portion of the nitrogen gas P is introduced into the coal mill through a sealing fan and sealed for later use; exhaust G discharged from the top of the coal mill is introduced into a second bag filter and collected therein to obtain pulverized coal C and the dedusted exhaust H, wherein the pulverized coal C is directly fed into a pulverized coal collecting tank and collected therein, a portion of the exhaust H is sent back to the nitrogen gas heater and heated therein to a preset temperature, and then introduced into the coal mill, while the other portion of the exhaust H is fed into the washing cooling tower and treated therein;

step 3: the exhaust D and the exhaust H are cooled and dehumidified in the washing cooling tower to form bottom liquid J in the bottom of the washing cooling tower, water vapour obtained by vacuum flashing cooling of the bottom liquid J is dehumidified and then introduced into a steam condenser to be condensed, so as to form clean water M which is transported to a condensate water recovery tank and stored therein, and while non-condensable gas that cannot be condensed is discharged into the air;

step 4: a portion of nitrogen gas E discharged from the side of the washing cooling tower is introduced into a carrier gas heater and heated therein, and then introduced into the input end of a rotary steam tube dryer for use as a dry carrier gas; the other portion of the nitrogen gas E is introduced into the nitrogen gas heater and heated therein, and then introduced into the coal mill for use as a medium for drying and milling, so as to form a nitrogen gas closed loop system;

step 5: the pulverized coal T and the pulverized coal C are mixed together in the pulverized coal collecting tank, then fed into the Venturi jet pump, mixed with air and burned in a boiler.

9. The method according to claim 8, wherein in step 1, the wet coal has a moisture content of 25 to 62%, and the wet coal is crushed such that it has a diameter of 20 mm or less.

10. The method according to claim 8, wherein in step 1, the heating steam has a hot steam pressure of 0.3 to 2.0 MPa and a temperature of 120 to 360° C., the dry carrier gas has a temperature below 120° C. and a carrier gas flow of 15000 to 35000 Nm3/h, and the heating and drying time is 30 to 60 min.

11. The method according to claim 8, wherein in step 1, the coal particles B have a moisture content of 15% or less, and the temperature of the dry gas F ranges from 90 to 110° C.

12. The method according to claim 8, wherein in step 1, the dry exhaust is fed into the first bag filter and dedusted therein at a pressure of 200 to 500 Pa and at a temperature of 90 to 110° C.

13. The method according to claim 8, wherein in step 2, the preset conditions include a hot-air pressure of 2000 to 6000 Pa and a temperature of 180 to 200° C., the preset time is 6 to 25 S, and the pulverized coal C has a moisture content of 2 to 5% or less.

14. The method according to claim 8, wherein in step 2, the nitrogen gas P is heated by the nitrogen gas heater to 180 to 200° C., 90% of the nitrogen gas P is fed into the coal mill, and 10% of the nitrogen gas P is introduced into the coal mill through a sealing fan and sealed for later use.

15. The method according to claim 8, wherein in step 2, after 15% of the exhaust H is sent back to the nitrogen gas heater and heated therein to 180 to 200° C., it is introduced into the coal mill, while 85% of the exhaust H is fed into the washing cooling tower and treated therein.

16. The method according to claim 8, wherein in step 3, the temperature of the bottom liquid J ranges from 80 to 90° C.

17. The method according to claim 8, wherein in step 3, the bottom liquid J treated after flash cooling is fed into the distributor of the washing cooling tower via a liquid level control system, and is brought into reverse contact with the exhaust D and the exhaust H again to be cooled and dehumidified so as to form a closed loop system, the cooling medium of the condenser is circulating cool water, and after the recovery of the water vapor in the exhaust D and the exhaust H, the remaining nitrogen gas E is recycled to Level 1 and Level 2 drying systems.

18. The method according to claim 8, wherein in step 4, the temperature of the nitrogen gas E emitted from the side of the washing cooling tower ranges from 45 to 65° C., wherein 35% of the nitrogen gas E is introduced into the carrier gas heater and heated therein to 120° C. or less, and then introduced into the input end of the rotary steam tube dryer for use as a dry carrier gas; 65% of the nitrogen gas E is introduced into the nitrogen gas heater and heated therein to 180 to 200° C., and then introduced into the coal mill for use as a medium for drying and milling, so as to form a nitrogen gas closed loop system, and a loss of nitrogen cycle of 5% or less is supplemented by an external system.

19. The method according to claim 8, wherein in step 5, the pulverized coal T and the pulverized coal C are mixed together in the pulverized coal collecting tank, discharged by a measuring rotary valve, then fed into the Venturi jet pump, mixed with air and burned in a boiler.

20. The method according to claim 8, wherein all of the heating media employed in a carrier gas preheater, a steam rotary dryer and the nitrogen gas heater come from steam extracted by the steam turbine.

* * * * *